US006681470B1

(12) United States Patent
Scott

(10) Patent No.: US 6,681,470 B1
(45) Date of Patent: Jan. 27, 2004

(54) METHOD OF MOUNTING AN AUGER TO A MOTOR VEHICLE

(76) Inventor: William A. Scott, W10543 Pleasant Acres, Summit Lake, WI (US) 54485

( * ) Notice: Subject to any disclaimer, the term of this patent is extended or adjusted under 35 U.S.C. 154(b) by 0 days.

(21) Appl. No.: 10/407,366

(22) Filed: Apr. 4, 2003

Related U.S. Application Data

(60) Provisional application No. 60/374,200, filed on Apr. 19, 2002.

(51) Int. Cl.[7] ..... E21B 7/02

(52) U.S. Cl. ..... 29/434; 173/28; 173/185; 173/186

(58) Field of Search ..... 29/401.1, 434, 29/525.01; 173/28, 39, 31, 141, 184, 185, 186, 187, 211; 172/254

(56) References Cited

U.S. PATENT DOCUMENTS 2,474,981 A * 7/1949 McCardell ..... 173/185
2,639,892 A * 5/1953 Jones ..... 173/140
5,158,146 A * 10/1992 Fuller ..... 173/28
5,363,925 A 11/1994 Gallagher ..... 173/186
5,836,402 A 11/1998 Jones ..... 173/185
6,056,065 A 5/2000 Campbell et al. ..... 172/42
6,260,633 B1 * 7/2001 Machek et al. ..... 173/184
6,305,882 B1 * 10/2001 Coast et al. ..... 173/28

* cited by examiner

*Primary Examiner*—Gregory Vidovich
*Assistant Examiner*—Jermie E. Cozart
(74) *Attorney, Agent, or Firm*—Donald J. Ersler

(57) ABSTRACT

An auger mounting assembly includes a slide bearing assembly and a mounting plate. The mounting plate is attached to a motor vehicle such as an all-terrain vehicle. The slide bearing assembly is pivotally retained by the mounting plate. An auger mounting bracket extends from the slide bearing assembly. The auger mounting bracket retains a handle of the auger. The slide bearing plate may be retained in a horizontal position for transport. A second embodiment of an auger mounting assembly includes a hitch bracket and the slide bearing assembly. The hitch bracket is attached to a hitch of a motor vehicle. The slide bearing assembly is pivotally mounted to the hitch bracket.

19 Claims, 8 Drawing Sheets

METHOD OF MOUNTING AN AUGER TO A MOTOR VEHICLE

CROSS-REFERENCES TO RELATED APPLICATIONS

This is a utility patent application taking priority from provisional application No. 60/374,200 filed on Apr. 19, 2002.

BACKGROUND OF THE INVENTION

1. Field of the Invention

The present invention relates generally to augers and more specifically to auger mounting assemblies for use with motor vehicles that allow a motor vehicle to support and retain an auger.

2. Discussion of the Prior Art

Augers are used on frozen lakes, ponds, etc., for drilling holes in ice for ice fishing as well as on land for drilling holes for fence posts, for example. In the recent past, hand-held, power driven augers have been used in these applications. However, because of their shape and weight, hand-held, power driven augers are bulky to transport and can be difficult to use. This is particularly true when the hand-held auger is used in cold weather for drilling holes in ice for ice fishing.

When drilling holes in ice for ice fishing, for example, it is common to drill several holes at different locations. This requires relocating the auger for each hole that has to be drilled. The auger has to be removed from the vehicle and hand carried to the point of use. Although vehicles such as automobiles or pickup trucks can be used to transport an auger to a location close to where holes are to be drilled, caution must be taken to insure that the ice will support the vehicle when the intended use is on a frozen lake. Also, in many cases, automobiles or pickup trucks may be unable to access trails or fence lines where fence post holes are to be drilled.

More recently, it has become customary to use smaller, more versatile vehicles, such as all-terrain vehicles (ATV), and even snowmobiles if the auger is to be used to drill holes in ice, for transporting an auger to a point of use. Because of their size, maneuverability, four-wheel drive capability, and relatively low weight, ATV's are particularly suitable for transporting augers to fence lines and trails as well as driving on frozen lakes. In most known cases, the vehicle is used only to transport the auger. The auger must be unloaded and set up for use. Most ATV's and snowmobiles have cargo or luggage racks on which to carry the auger. However, because most augers are made of metal, the auger will scratch the cargo rack during loading and unloading of the auger.

In U.S. Pat. No. 5,836,402, issued to Wayne Jones, there is disclosed an auger holder for mounting an auger on a vehicle such as an ATV, both for transporting the auger to a point of use and for enabling the auger to be operated while attached to the vehicle. The auger holder includes a primary frame coupled to a vehicle and a secondary frame adjustably connected to the primary frame. The primary frame includes a structure of vertical and horizontal support members. The auger is carried by the secondary frame and moveable therewith relative to the primary frame. The auger holder further includes a locking mechanism for securing the secondary frame to the primary frame when the auger is not in use. The auger holder further includes a hinge pivot enabling the auger to be tilted forward and backward relative to the vehicle.

Although this auger holder facilitates transportation of an auger and stabilizes the auger in use, the auger holder mounts on the top of the cargo rack of the ATV and is connected to the hitch mount of the ATV. Moreover, the auger holder is mounted so that the auger is centered on the rear of the ATV. Consequently, the ATV cannot haul cargo or pull a trailer without first removing the auger and the auger holder from the vehicle.

Accordingly, there is a clearly felt need in the art for auger mounting assemblies for use with motor vehicles that allows an auger to be supported by a motor vehicle, transported by a motor vehicle and operated by a single individual with less effort.

SUMMARY OF THE INVENTION

The present invention provides auger mounting assemblies for use with motor vehicles that allow an auger to be operated by a single individual. The auger mounting assembly includes a support mechanism which enables the auger to be oriented in a generally vertical use position and a generally horizontal storage position. The auger can be locked in a storage position.

In a first embodiment, the auger mounting assembly includes a slide bearing assembly which supports an auger and provides linear positioning of the auger. The auger mounting assembly further includes a swivel bearing assembly which couples the slide bearing assembly to the vehicle for rotation about a pivot axis. In accordance with a feature of the invention, the slide bearing assembly of the auger mounting assembly rotates about a pivot axis that extends in the direction of travel of the vehicle so that the slide bearing assembly and the auger rotate in a plane that extends perpendicular to the direction of travel of the vehicle. Consequently, the vertical orientation of the auger can be adjusted over a range of 360 degrees within a plane that extends normal to the direction of travel of the vehicle.

Further in accordance with the invention, the auger mounting assembly includes a mechanical bias arrangement which provides assistance in lifting the auger back up out of a hole that has been drilled. This is particularly advantageous when the auger used for drilling holes in a layer of ice formed on the surface of a frozen body of water.

The auger mounting assembly enables use of the all-terrain vehicle in the conventional manner while the auger remains mounted on the vehicle. For example, because the auger is orientated generally horizontally during storage and/or transport, the cargo rack of the vehicle remains accessible for use. Moreover, because the auger and the slide bearing assembly are oriented horizontally when in the storage position, the trailer hitch of the vehicle remains exposed, enabling a trailer to be hitched to the all-terrain vehicle while the auger remains attached to the vehicle.

A second embodiment of an auger mounting assembly includes a hitch bracket and the slide bearing assembly. The hitch bracket is attached to a hitch of a motor vehicle. The slide bearing assembly is pivotally mounted to the hitch bracket. An auger is mounted to the slide bearing assembly. The hitch bracket includes a hitch receiver, a support member and rotation support member. The hitch receiver is sized to be received by a hitch of the motor vehicle. One end of the support member is attached to the hitch receiver and the other end of the support member is attached to the rotation support member. The slide bearing is pivotally retained by the rotation support member.

Accordingly, it is an object of the present invention to provide an auger mounting assembly, which may be attached to a luggage rack of an all-terrain vehicle.

It is a further object of the present invention to provide an auger mounting assembly, which may be attached to a hitch of a motor vehicle.

Finally, it is another object of the present invention to provide auger mounting assemblies, which may be rotated to transport an auger from one location to another.

These and additional objects, advantages, features and benefits of the present invention will become apparent from the following specification.

DETAILED DESCRIPTION OF THE PREFERRED EMBODIMENTS

Figure 1:
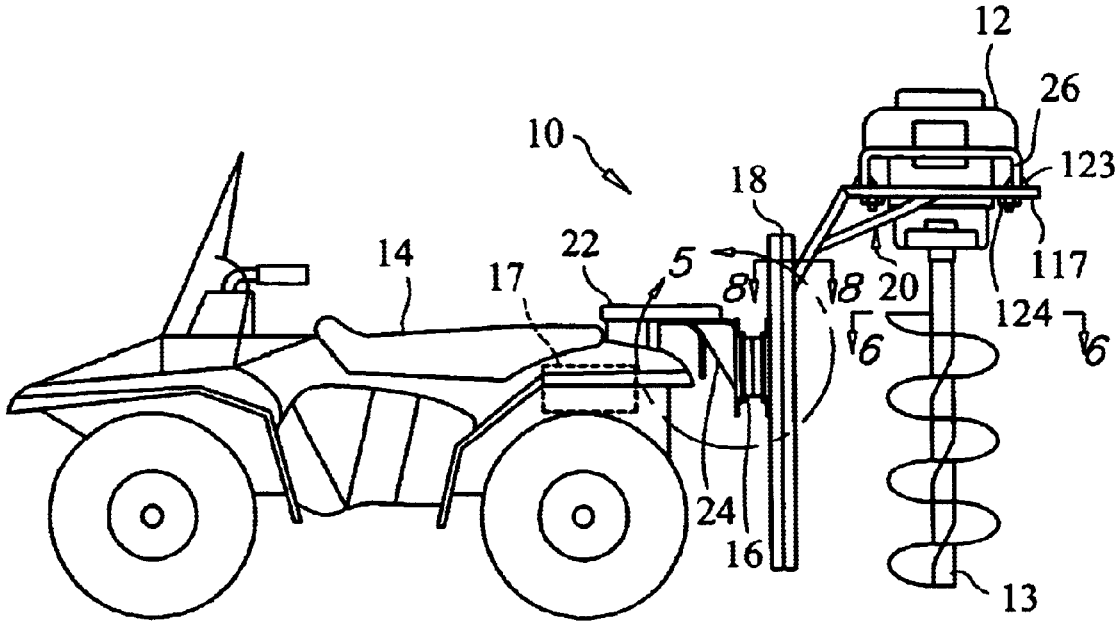
FIG. 1 is a side elevation view of an all-terrain vehicle with an auger mounted thereon by an auger mounting assembly in accordance with one embodiment of the present invention.

Referring to FIG. 1 of the drawings, an auger mounting assembly 10 in accordance with the present invention is described with reference to mounting an auger 12 on a motor vehicle, commonly referred to as an all-terrain vehicle (ATV) 14. The mounting assembly 10 supports the auger 12 on the ATV 14 and enables the auger 12 to be oriented in an upright, generally vertical use position shown in FIGS. 1 and 2 and in a horizontal transport or storage position shown in FIG. 3. The auger 12 can be rotated from the storage position to be oriented in any angle for use.

The auger 12 can be a conventional, hand-held-type, power driven auger which can be driven by a gasoline engine or by an electric motor. However, other types of augers may also be used, besides hand-held, such as augers have greater than three horsepower. The electric motor can obtain power from a battery 17 which can be the twelve volt battery of the ATV or a separate twelve volt battery that is carried by the ATV.

The auger mounting assembly 10 includes a swivel bearing assembly 16, a slide bearing assembly 18 and an auger support bracket 20. Preferably, the auger mounting assembly 10 is attached to the underside of the cargo rack 22 of the ATV by a mounting plate 24. The auger 12 is supported on the slide bearing assembly 18 which provides linear movement of the auger relative to the vehicle. The slide bearing assembly 18 is supported on the swivel bearing assembly 16 which provides rotational movement of the slide bearing assembly 18 and the auger supported thereby, relative to the vehicle. The auger support bracket 20 projects rearwardly and upwardly from the slide bearing assembly 18 and supports the auger 12 by the auger handle 26.

The swivel bearing assembly 16 enables the slide bearing assembly 18 to be rotated a full 360° about a pivot axis. However, when the vehicle is situated on flat ground, only 90° of rotation is required to rotate the auger 12 from the horizontal storage position to a vertical use position.

Figure 5:
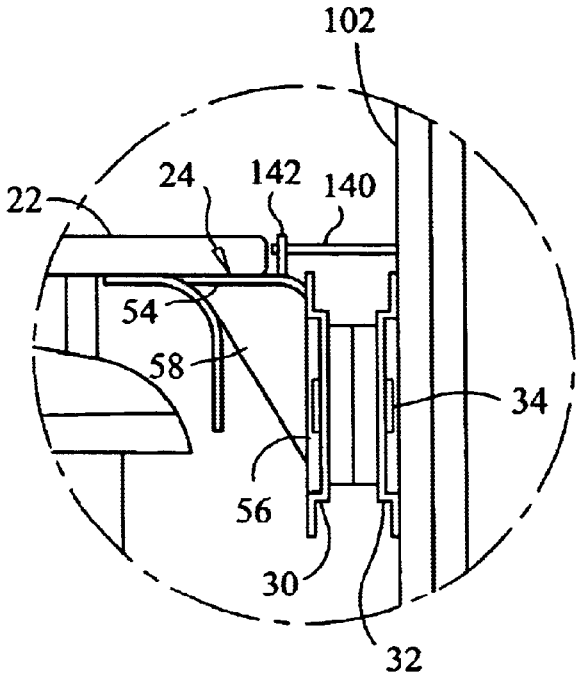
FIG. 5 is an enlarged, close up side view of a swivel bearing assembly of the auger mounting assembly of FIG. 1.
Figure 6:
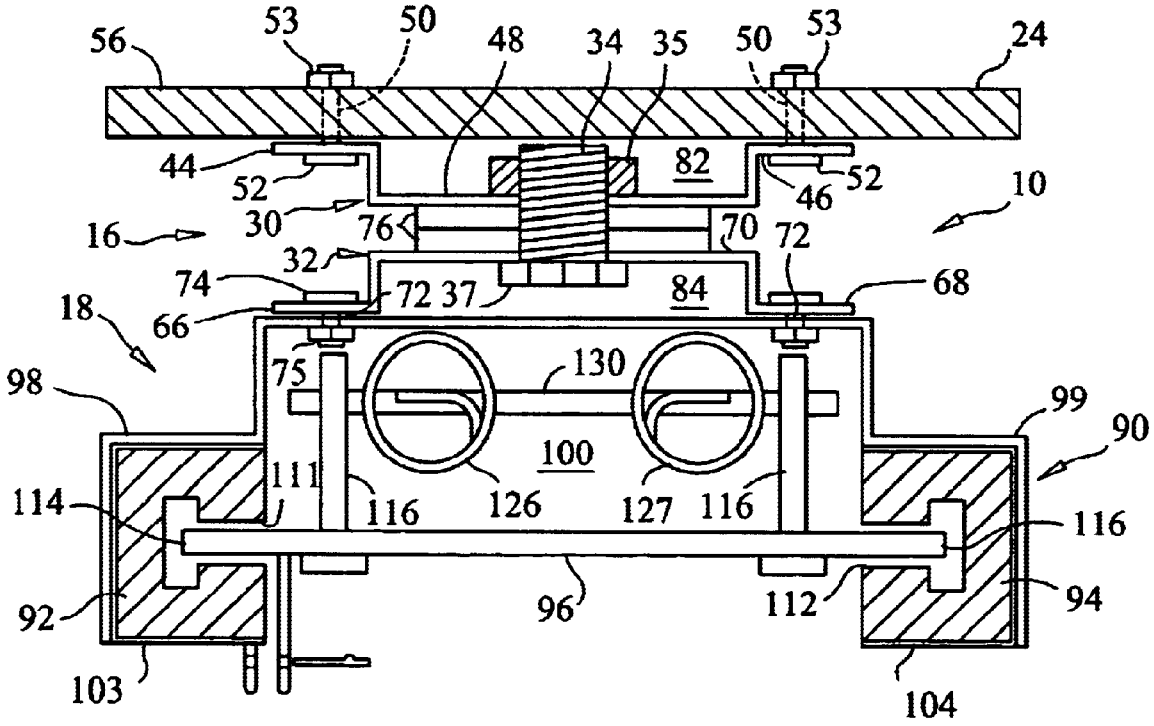
FIG. 6 is a transverse section view taken along the line 6—6 of FIG. 1.
Figure 7:
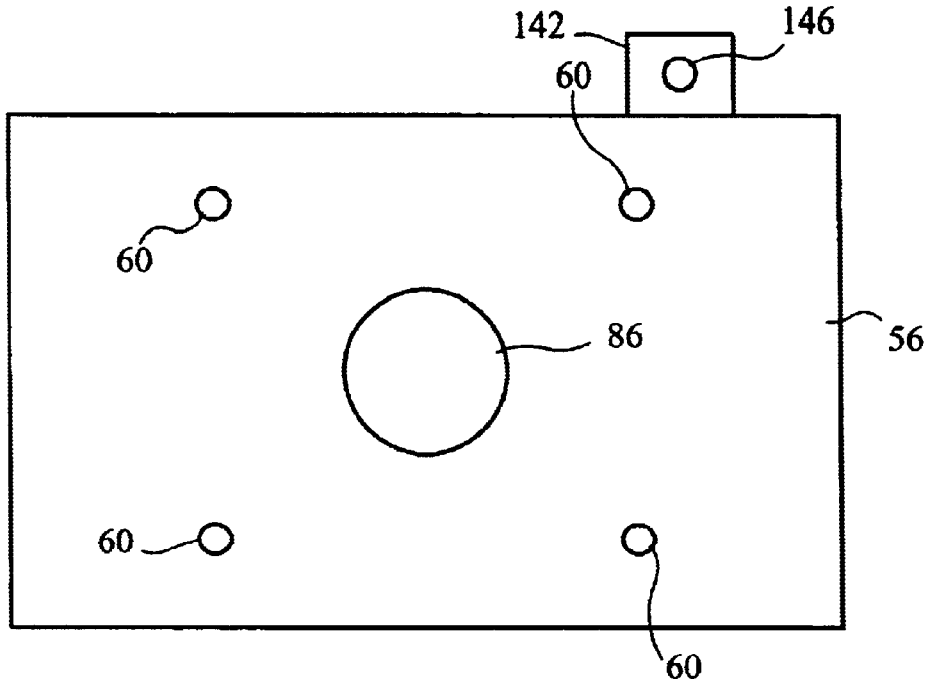
FIG. 7 is a front elevation view of a mounting bracket of the auger mounting assembly of FIG. 1.
Figure 8:
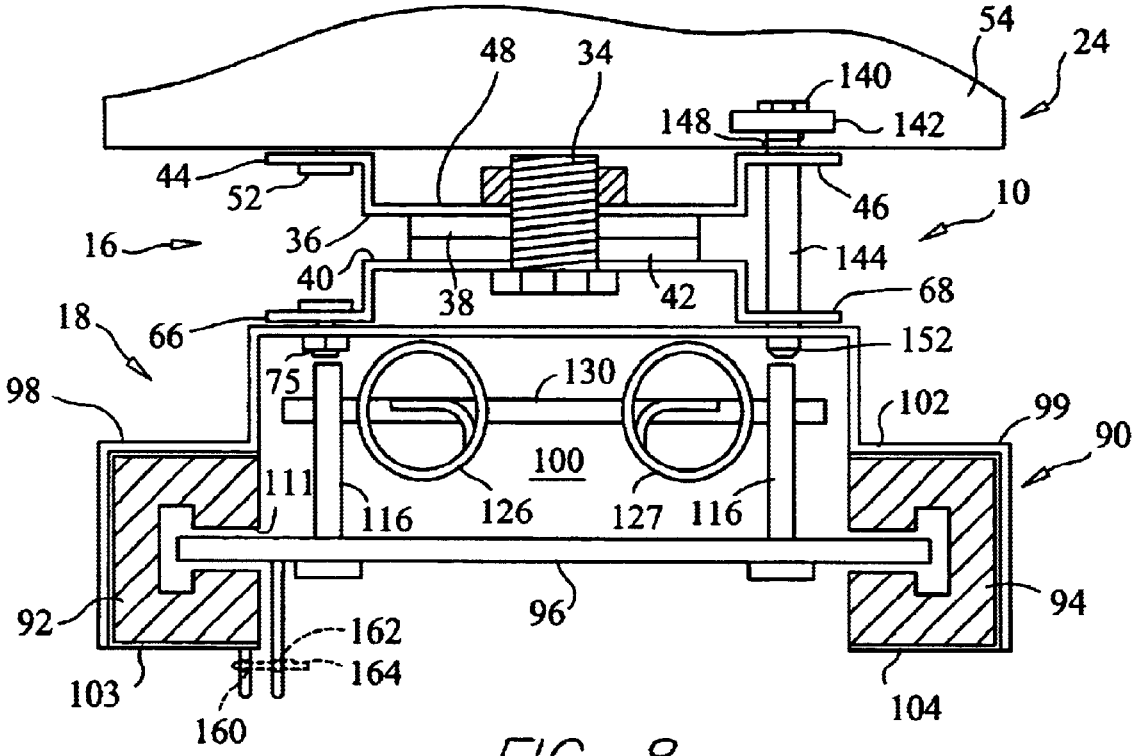
FIG. 8 is a transverse section view taken along the line 8—8 of FIG. 1.

Referring to FIGS. 5, 6 and 8, the swivel bearing assembly 16 includes an inner bearing assembly 30, an outer bearing assembly 32 and a pivot pin 34. The pivot pin 34 secures together the inner and outer bearing assemblies 30 and 32, enabling relative pivoting movement therebetween.

The inner bearing assembly 30 includes a support plate 36 supporting an inner bearing member 38. The outer bearing assembly 32 includes a support plate 40 supporting an outer bearing member 42. Each support plate, such as support plate 36 is generally rectangular in shape and is bent along its side edges defining mounting flanges 44 and 46 which extend along the side edges and are offset outwardly with respect to the plane of a base portion 48 of the support plate. Each of the mounting flanges 44 and 46 of support plate 36 include a pair of mounting apertures 50 for receiving fasteners, such as bolts 52 and nuts 53, by which the swivel bearing assembly 16 is secured to the mounting plate 24.

Referring to FIGS. 5–8, the mounting plate 24 is a right angle member with horizontal mounting portion 54 which attaches to the vehicle 14 and a vertical portion 56 to which the slide bearing assembly 18 is attached. The mounting plate 24 can include side members 58 on both sides joining the horizontal and vertical mounting portions 54 and 56 for strengthening the mounting plate. The mounting plate 24 includes a plurality of mounting apertures 60 which are aligned with apertures 50 in the mounting flanges 44 and 46 for receiving bolts 52 which are held in place by nuts 53.

Similarly, the support plate, 40 includes lateral mounting flanges 66 and 68 which are offset with respect to the plane of a base portion 70 of the support plate 40. Each of the mounting flanges 66 and 68 include a pair of mounting apertures 72 for receiving fasteners by which the slide bearing assembly 18 is secured to a slide bearing frame 90 of the swivel bearing assembly 16. The fasteners are bolts 74 and nuts 75. The slide bearing frame 90 has a main body portion 102, shown in FIG. 9, which includes a plurality of mounting apertures 77, 177 which are aligned with mounting apertures 72 of support plate 40.

Figure 9:
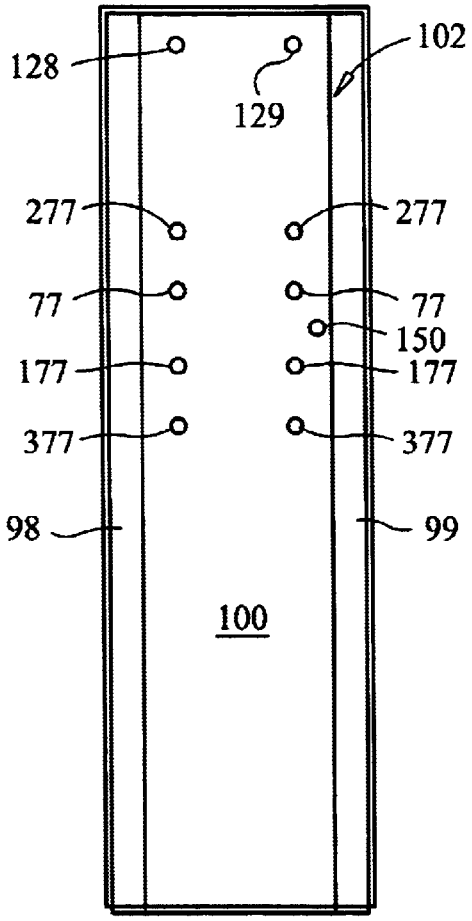
FIG. 9 is a front elevation view of a main body portion of a frame of the auger mounting assembly of FIG. 1.
Figure 11:
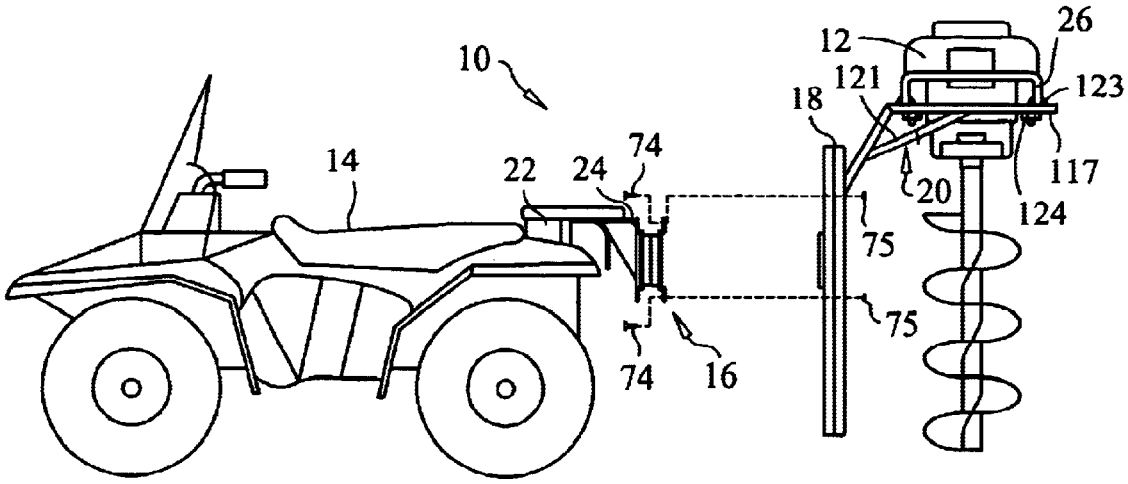
FIG. 11 is a view similar to that of FIG. 1 with the auger mounting assembly shown removed from the vehicle.

Digressing, with reference to FIGS. 9 and 11, if for any reason it is desired to temporarily remove the auger from the ATV, the slide bearing assembly 18 is disconnected from the swivel bearing assembly 16. The swivel bearing assembly can remain mounted on the ATV as shown. The main body portion of the slide body frame 102 includes a further pair of mounting apertures 277 that are located adjacent to mounting apertures 77 and a further pair of mounting apertures 377 that are located adjacent to mounting apertures 177. This provides for variation in the mounting height for the auger mounting assembly 10 by using different patterns or sets of apertures.

For example, the use of a mounting aperture set including mounting apertures 77, 77, 277 and 277, will result in the assembly being mounted lower on the ATV and the use of a mounting aperture set including mounting apertures 177, 177, 377 and 377, will result in the assembly being mounted higher on the ATV. The mounting apertures 77, 177, 277 and 377 are aligned and spaced equally longitudinally of the slide body frame 102. However, in other embodiments, the spacing between mounting apertures 77 and 277, for example can be less than or greater than the spacing between mounting apertures 77 and 177. Also, the transverse spacing can be different for different pairs of apertures.

For example the spacing between aperture pair 277 can be less than or greater than the spacing for aperture pair 77. Additional mating holes can be provided on the support plate 40. This variable mounting arrangement enables the auger mounting assembly 10 to be adapted to differences in the height of the cargo rack with respect to ground that exist for all-terrain vehicles produced by different manufacturers, for example.

Referring again to FIGS. 5–8, the inner and outer bearing members 38 and 42 are generally circular in shape and have opposing smooth bearing surfaces which are in engagement. The inner and outer bearing members 38 and 42 can be attached to the respective support plates in any suitable manner. Preferably, the inner and outer bearing members 38 and 42 are secured to respective support plates 36 and 40 by welds as indicated at 76, for example.

The pivot pin 34 extends through aligned apertures in the inner and outer bearing members 38 and 42 and in the support plates 36 and 40 and is held in place by a nut 35. The offset flanges 44 and 46 of support plate 36 define a recess 82 which locates the nut 35. Similarly, the offset flanges 66 and 68 of support plate 40 define a recess 84 which locates a head 37 of the pivot pin 34. The mounting plate 24 can include an opening 86, shown in FIG. 7, aligned with the pivot pin 34.

Figure 10:
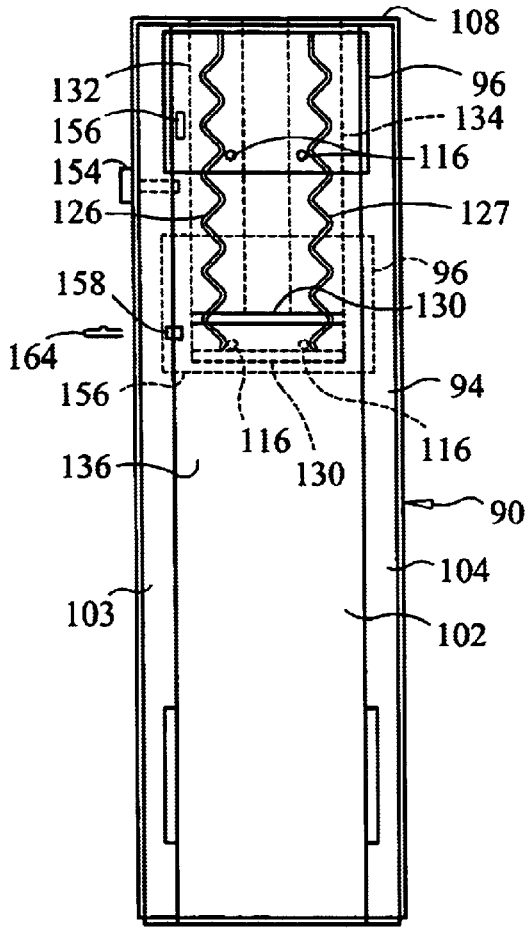
FIG. 10 is a simplified view illustrating a frame, a sliding bracket pad and bias springs of a slide bearing assembly of the auger mounting assembly of FIG. 1, with the sliding bracket pad shown in a top of travel position and shown in phantom moved downwardly away from the top of travel position.

Referring to FIGS. 6, 9 and 10, the slide bearing assembly 18 includes a slide bearing frame 90, a pair of slide rails 92 and 94 and a sliding bracket pad 96. Preferably, the slide bearing frame 90 includes a tunnel or main body portion 102 and cover plates 103 and 104. The main body portion 102 is generally rectangular in shape and includes sides 98 and 99 which are stepped outward laterally and then forwardly as shown in FIG. 6, for example, defining a recess 100 in the center portion of the frame 90. The main body portion 102 preferably is of metal and may be produced by stamping.

The cover plates 103 and 104 are secured to the main body portion 102, closing the front portion of the slide bearing frame 90, defining a pair of three-sided compartments at opposite sides of the frame in which are contained the slide rails 92 and 94. The slide bearing frame 90 can be closed at the top and bottom by cap members 108 and 110.

The slide rails 92 and 94 are located on opposite sides of the slide bearing frame 90 and extend generally vertically when the mounting assembly 10 is oriented in the use position as shown in FIG. 1. The slide rails 92 and 94 include channels 111 and 112 in which ride the edges 114 and 116, respectively of the sliding bracket pad 96. Preferably, the channels 111 and 112 have a T-shaped cross section. The slide rails 92 and 94 may be fabricated from a rigid plastic material.

The sliding bracket pad 96 is a flat, rigid generally rectangular member. The thickness of the sliding bracket pad 96 is slightly less than the thickness of the channels 111 and 112. The sliding bracket pad 96 includes one or more pick-up pins 116 which project inwardly near the lower edge of the sliding bracket pad 96 for engaging a bias mechanism of the slide bearing assembly 18 as will be shown. The sliding bracket pad 96 can be of metal.

Figure 2:
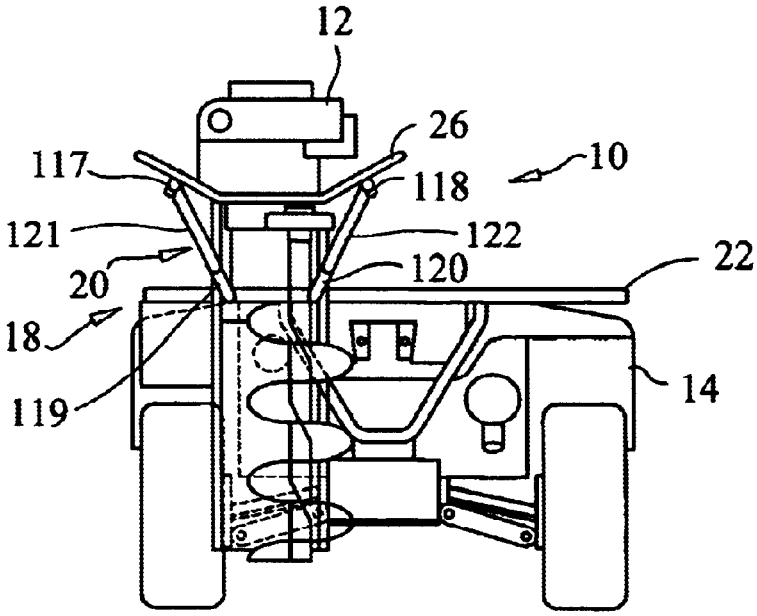
FIG. 2 is a rear elevation view of the all-terrain vehicle of FIG. 1, showing the auger in an upright auger top of travel position prior to being deployed.
Figure 3:
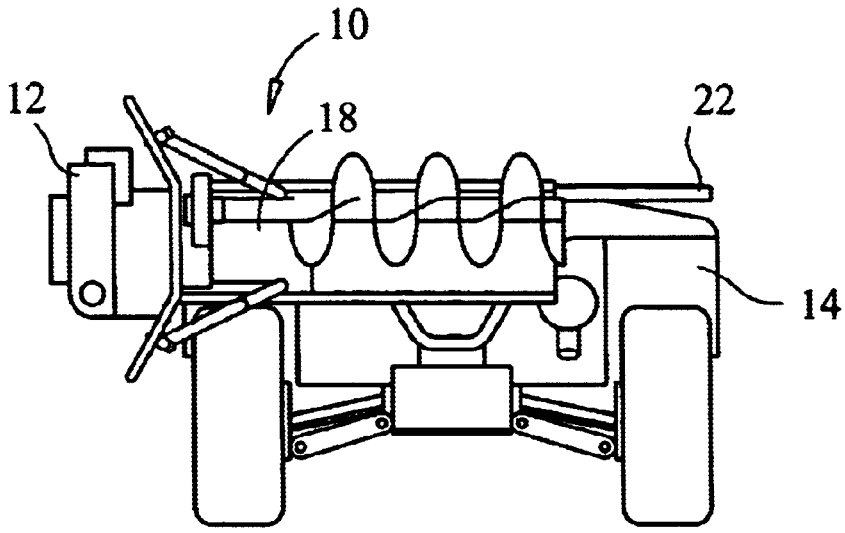
FIG. 3 is a view similar to that of FIG. 2 and showing the auger in a horizontal storage position in which the auger is offset to one side of the vehicle.

Referring to FIGS. 1, 2 and 11, the auger mounting bracket 20 preferably includes a first support member 117, a second support member 118, a first upright member 119, a second upright member 120, a first gusset member 121 and a second gusset member 122. One end of the first upright member 119 is attached to the sliding bracket pad 96 of the slide bearing assembly 18 and the other end is attached to an end of the first support member 117. One end of the second upright member 120 is attached to the sliding bracket pad 96 and the other end is attached to an end of the first support member 118. One end of a first gusset member 121 is attached to first support member 117 and the other end is attached to the first upright member 119. One end of a second gusset member 122 is attached to first support member 118 and the other end is attached to the first upright member 120. The first and second gusset members support the weight of the auger 12. A plurality of hook holes are formed through the first and second support members to receive four J-hooks 123. A retention knob 124 is threaded on to each J-hook 123 to secure the auger handle 26 to the auger mounting bracket 20. However, other fastening devices may be used to retain the auger handle 26.

Referring to FIGS. 6, 8 and 10, the sliding bracket assembly 18 preferably includes a bias mechanism for assisting in moving the auger 12 out of a hole that has been drilled. By way of illustration, the bias mechanism can include one or more tension springs 126, 127 which are incorporated into the slide bearing frame 90 of the slide bearing assembly 18. The springs tension 126, 127 are located in the recess 100 defined by the frame 90. The upper ends of the springs 126, 127 can be secured to the main body portion 102 near the upper end of the frame 90, such as by locating the hooked ends of the springs in apertures 128, 129 in the main body portion or hooking the springs onto hardware that is mounted to the main body portion 102 using the apertures 128 and 129. The tension springs 126, 127 extend longitudinally of the frame 90 from the top toward the bottom of the frame 90 with lower ends interconnected by a tie bar 130.

Preferably, the tension springs 126, 127 are initially not tensioned. The tension springs 126, 127 and are tensioned in response to downward movement of the sliding bracket pad 96, which causes the pick-up pins 116 of the sliding bracket pad 96 to be moved into engagement with the tie bar 130. The tie bar 130 is also moved downwardly, tensioning the tension springs 126, 127, with continued downward movement of the sliding bracket pad 96.

In another embodiment, the frame 90 can include spring guides for the tension springs 126, 127. Preferably, the spring guides are configured as tubes 132, 134, represented by the dashed lines in FIG. 10, which are provided on the inner surface 136 of the main body portion 102. In this embodiment, the lower ends of the springs 126, 127 extend from the tubes 132, 134 and are interconnected by tie bar 130.

It is apparent that with suitable modification, compression springs can be used in place of the tension springs. Also, other types of bias devices can be used. However, the sliding bracket assembly 18 does not require the bias mechanism 125 or the tension springs 126, 127 for satisfactory operation.

Referring to FIGS. 5, 7 and 8–10, in one embodiment, the auger 12 is held in a position to which it has been rotated by a catch and release mechanism. The catch and release mechanism preferably includes a spring-loaded locking pin 140 that cooperates with the slide bearing frame 90 to lock the slide bearing assembly 18 against rotation relative to the motor vehicle. The locking pin 140 is supported by an upstanding member 142 located on the mounting plate 24. The shank 144 of the locking pin 140 extends through an aperture in the member 142. A spring 148 biases the locking pin 140 into engagement with the main body portion 102 of the slide bearing frame 90. The main body portion 102 has an opening 150 therethrough which receives the tip 152 of the locking pin 140 when the slide bearing assembly 18 and the auger 12 carried thereby has been rotated through 90°.

Referring to FIGS. 8 and 10, the sliding bracket pad 96 can be held in locked position during rotation, preventing side-to-side movement of the sliding bracket pad 96 of the slide bearing assembly 18, while the slide bearing assembly 18 is being rotated from the horizontal storage position to the vertical use position, and back to the storage position. The locking function is provided by a locking mechanism that preferably includes a locking pin 154 mounted in the side of the main body portion 102. The locking pin 154 is located to project into the channel 111 at a location that is below the sliding bracket pad 96 when deployed, preventing the sliding bracket pad 96 from moving downwardly.

The slide bearing frame 90 is sufficiently long as to define a length of travel for the auger from the top of travel position shown in FIGS. 1 and 11, for example, to an end of travel position at which the lower edge of the sliding bracket pad 96 is one or two inches above ground level, to enable substantially the entire cutting bit of the auger 12 to be extend into a hole being drilled when the sliding bracket pad has been moved to its end of travel position. The width of the slide bearing frame 90 can be slightly greater than the width of the auger.

Referring to FIGS. 3, 4, 8 and 10, in one embodiment, the auger mounting assembly 10 is mounted on the rear left side of the ATV. Thus, when the auger mounting assembly is rotated from the vertical use position to the horizontal storage position, the center of gravity of the auger mounting assembly 10 and the auger 12 is offset with respect to the center of the ATV 14. In accordance with a preferred embodiment, the slide bearing assembly 18 includes a further locking mechanism that enables the sliding bracket pad 96 to be maintained in a centered position, shown in FIG. 4, during travel. The locking mechanism preferably includes a pair of projections, such as projection 156 on the sliding bracket pad 96 and projection 158 on the cover plate 101. The projections 156 and 158 have apertures 160 and 162, shown in FIG. 8, which become aligned when the auger 12 is centered on the vehicle 14. The projections are coupled together with a suitable fastener. For example, the fastener can be a cotter pin 164 passed through the apertures 160 and 162 to secure the sliding bracket pad 96 to the sliding bearing frame 90. The bias springs 126, 127 are (picked up) contacted/extended at this point to apply a slight bias to the slide bearing assembly 18 to prevent rattling during transport.

With reference to FIGS. 1–4, the auger mounting assembly 18 is located at the rear left side of the ATV 14. However, it is apparent that the auger mounting assembly 10 can be mounted on the right rear side of the ATV, and that the transport position can be the mirror image of that illustrated in FIG. 3 or the auger mounting assembly can be shifted from the right of the ATV toward the center of the ATV in the manner described above with reference to FIG. 4.

When not in use, the auger 12 is preferably maintained locked in the transport and storage position by the locking pins 140 and 164. When it is desired to use the auger to drill one or more holes, the ATV 14 is driven to the location where the holes are to be drilled and parked with the auger 12 located in a position such that when the auger is rotated the vertical use orientation, the tip 13 of the auger 12 will be in the proper position to drill the hole.

Figure 4:
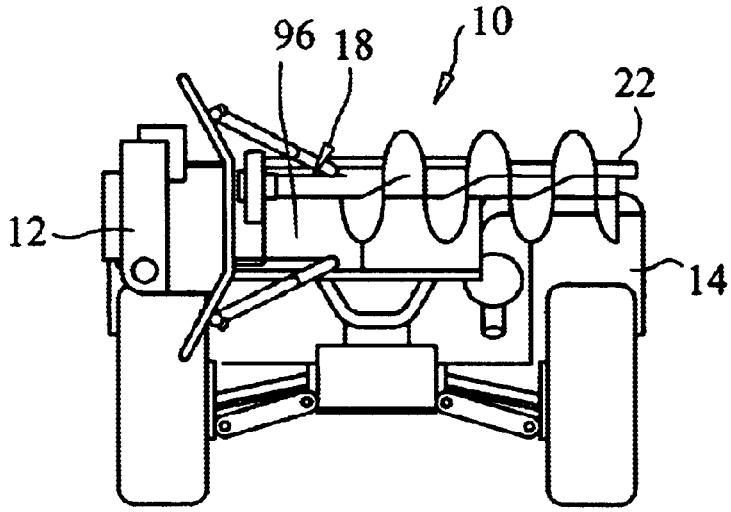
FIG. 4 is a view similar to that of FIG. 3 and showing a storage position in which the auger centered on the vehicle.

With the ATV 14 so positioned, the operator removes the cotter pin 164, which enables the sliding bracket pad 96 to be moved toward the top of travel position, which is at the left side of the vehicle when the slide bearing assembly 18 is oriented horizontally, as shown in FIG. 4. The operator moves the auger, and thus the sliding bracket pad 96, leftwardly to the top of travel position, and then inserts the locking pin 154 into the aperture 150 to lock the sliding bracket pad 96 in its top of travel position while the auger is being rotated to the use position. The operator then withdraws the locking pin 140 and rotates slide bearing assembly 18 to the use position. As is stated above, the auger mounting assembly 10 can rotate 360° in a plane perpendicular to the direction of travel of the vehicle. Normally, the vehicle is located on flat ground 15 so that only 90° of rotation from the horizontal storage position to the use position.

When in the use position, the auger 12 hangs vertically due to the force of gravity. The locking pin 140 is not engaged so that the auger can be pivoted about the pivot axis if desired. When the auger 12 is in the use position, the operator removes the locking pin 154. With the locking pin 154 removed, the sliding bracket pad 96 moves downwardly until the tip 13 of the auger 12 engages the underlying surface 15. The engagement of the auger tip 13 with the ground surface 15 adds to the stabilization for the auger 12 afforded by the auger mounting assembly 10 that attaches the auger to the ATV. The length of the slide bearing assembly is preferably selected such that the bias springs 126, 127 are not placed in tension until after an inch or two of downward movement of the sliding bracket pad 96 during drilling of a hole. The bias springs 126, 127 assist only in moving auger 12 back out of the hole, and not in moving the auger downwardly into engagement with the underlying surface.

To use the auger 12, the operator energizes the auger 12 to drill the hole, pushing down on the auger during drilling, moving the auger 12 downwardly against the force of the tension springs 126, 127, until the hole has been drilled to the depth desired in the case of post hole drilling, or through the ice in the case of drilling holes for ice fishing.

As the sliding bracket pad 96 moves downwardly with the auger 12, the pick-up pins 116 initially engage the tie bar 130 connected to the lower ends of the tension springs 126, 127. Further downward movement of the sliding bracket pad 96 results in downward movement of the tie bar 130, tensioning of the tension springs 126, 127. Thus, the tension springs 126, 127 become tensioned as the result of the sliding bracket pad 96 being moved downwardly with the auger 12, against the force of the bias springs.

When the drilling of the hole is complete, the operator deenergizes the auger 12 and stops pushing down on the auger 12, enabling the auger 12 to be moved upwardly by the force of the tension springs 126, 127, until the tip 13 of the auger 12 is located near the upper portion of the hole that has been drilled.

When the drilling is completed, the operator raises the slide bracket pad 96, and the auger 12, to its top of travel position. Then, the operator replaces the locking pin 154 to prevent the slide bracket pad 96 and the auger from moving linearly along the slide bars while the slide bearing assembly 18 is being rotated back to the horizontal storage position. The operator rotates the slide bearing assembly 18 to a horizontal orientation. When the slide bearing assembly 18 reaches the horizontal position shown in FIG. 3, the operator removes the pin 154. The operator then slides the slide bearing assembly 18 and the auger 12 toward a centered, storage position shown in FIG. 4, until the apertures 160 and 162 in the projections 156 and 158 are aligned. The operator applies the cotter pin 164 to lock the slide bearing assembly 18 in the storage position, preventing the auger 12 from having side-to-side movement. As the result of the movement of the sliding bracket pad 96 away from the top of travel position, the bias springs 126, 127 are picked up through the action of the pins 116 and the tie bar 130, so that the tension springs 126, 127 are tensioned slightly to apply a slight bias to components of the slide bearing assembly 18 for preventing rattling during transport.

Figure 12:
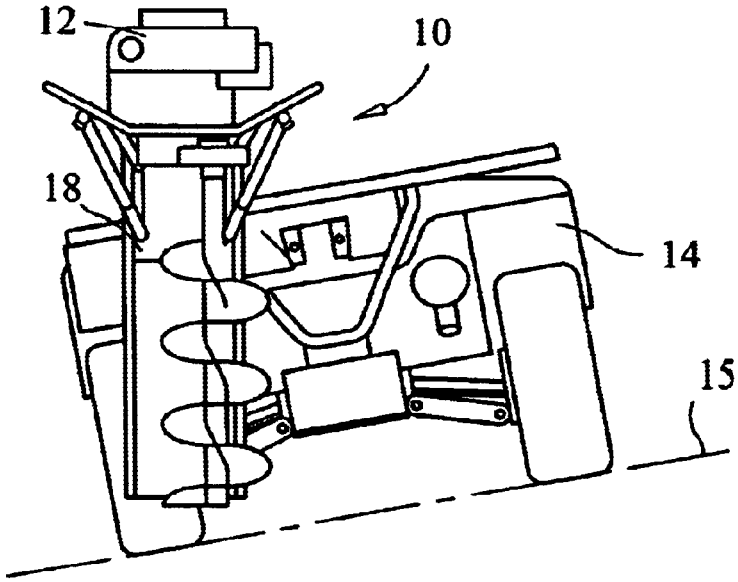
FIG. 12 is a view showing the all-terrain vehicle on an angle with the auger ready to create a hole.
Figure 13:
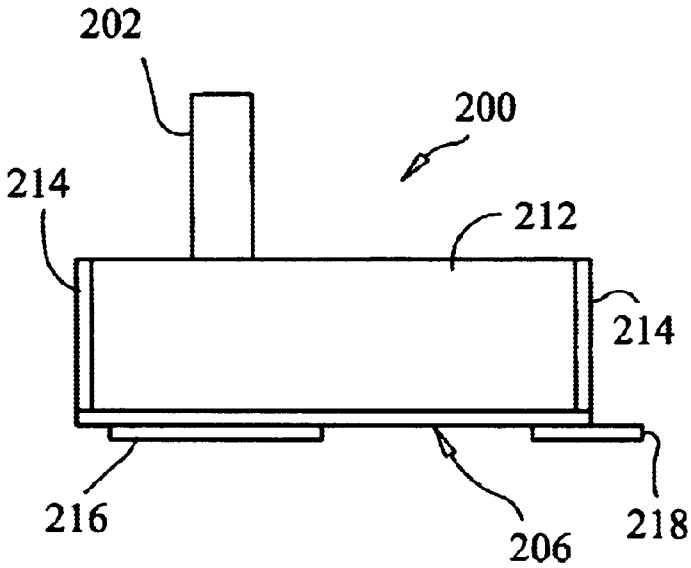
FIG. 13 is a top view of a hitch bracket of a second embodiment of a auger mounting assembly.
Figure 14:
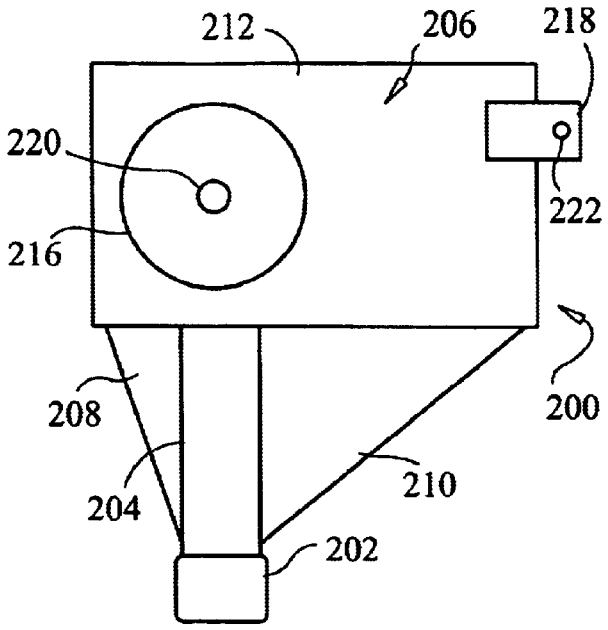
FIG. 14 is a front view of a hitch bracket of a second embodiment of a auger mounting assembly.
Figure 15:
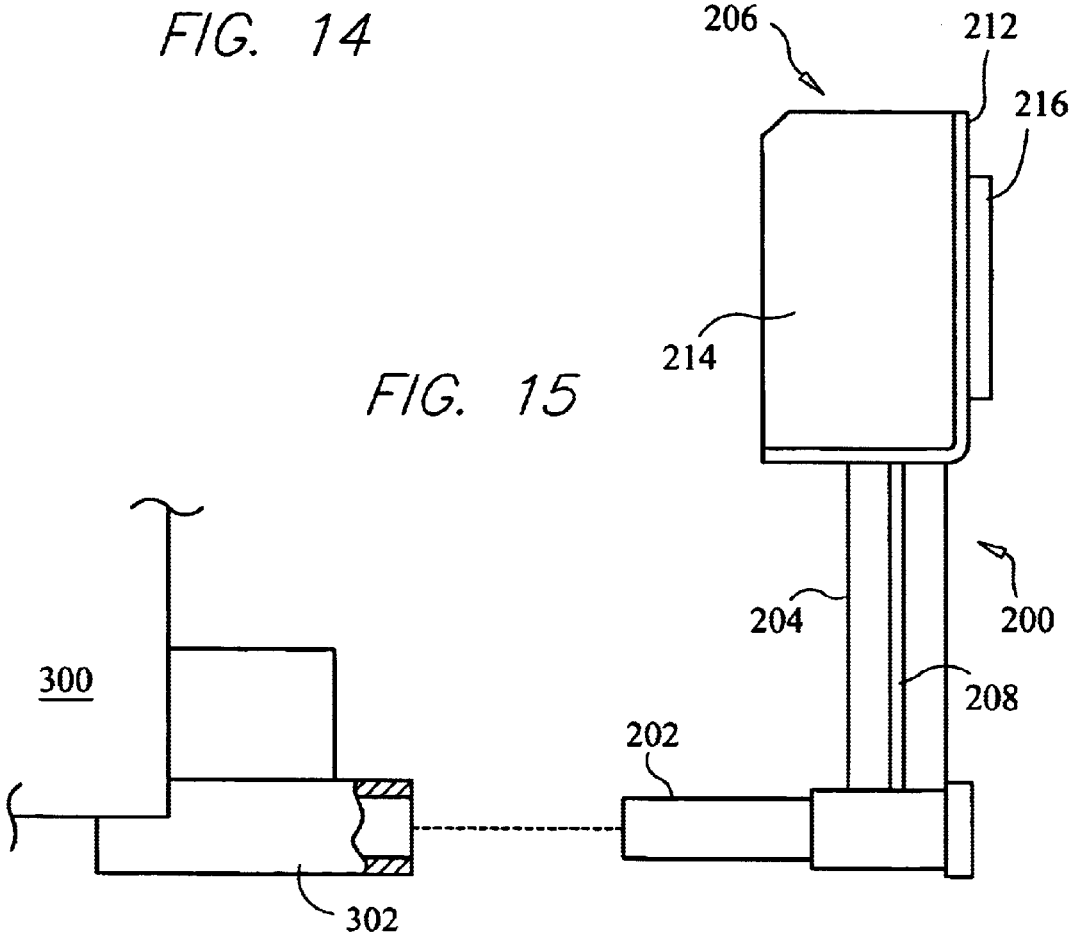
FIG. 15 is a side view of a hitch bracket of a second embodiment of a auger mounting assembly.
Figure 16:
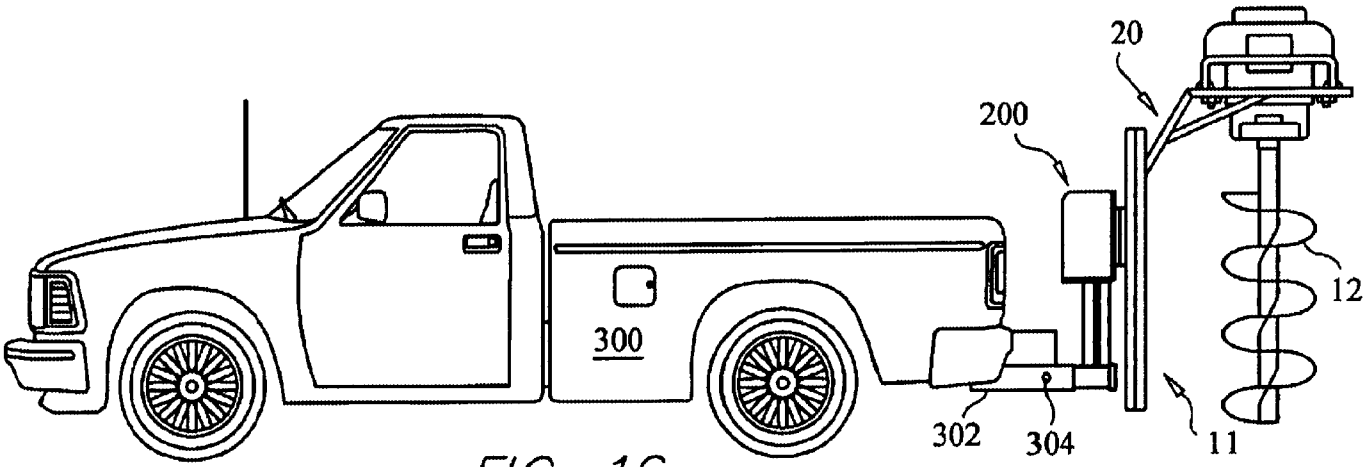
FIG. 16 is a side view of a second embodiment of a auger mounting assembly attached to motor vehicle.

Referring to FIG. 12, which is a view showing the ATV 14 parked on a surface 15 that is inclined with respect to the horizontal, with the auger 12 deployed. [Because the slide bearing assembly 18 of the auger mounting assembly 10 rotates in a plane that extends perpendicular to the direction of travel of the vehicle, the auger 12 can be deployed at any angle with respect to an axis that extends along the direction of travel of the ATV.] This obviates the need to back the ATV up a hill when a hole is to be drilled in a sloping surface, for example. In contrast, in prior art units, such as the one shown in U.S. Pat. No. 5,836,402, which has been referred to above, the vehicle must be backed up a sloping surface when it is desired to deploy the auger on a sloping surface.

With reference to FIGS. 13–16, a second embodiment of an auger mounting assembly 11 includes a hitch bracket 200 and the slide bearing assembly 18. The hitch bracket 200 is attached to a hitch 302 of a motor vehicle 300. The hitch bracket 200 preferably includes a hitch tongue 202, a support member 204 and a rotation support member 206. The hitch tongue 202 is sized to be received by the hitch 302. The hitch 302 is preferably a square type, but other types of hitches may also be used.

A fastener 304 or the like may be used to secure the hitch tongue 202 in the hitch 302. One end of the support member 204 is attached to the hitch tongue 202 and the other end is attached to the rotation support member 206. A first support gusset 208 and a second support gusset 210 are preferably used to retain the rotation support member 206 on the top of the support member 204. The hitch tongue 202, the support member 204, the rotation support member 206, the first support gusset 208 and the second support gusset 210 are preferably attached to each other with welding or any other suitable attachment process.

The support member 206 preferably includes an L-shaped mounting member 212, a pair of mounting gussets 214, an outer bearing member 216 and a locking plate 218. The pair of mounting gussets 214 are attached to each end of the L-shaped mounting member 212. The outer bearing member 216 is attached to a front of the L-shaped mounting member 212, adjacent the support member 204. The locking plate 218 is attached to an end of the L-shaped mounting member 212. A pivot hole 220 is formed through the outer bearing member 216 and the L-shaped mounting member 212 to receive the pivot pin 34 of the slide bearing assembly 18. The outer bearing member 216 will contact the inner bearing member 38 of the slide bearing assembly 18. The slide bearing assembly 18 is pivotally mounted to the hitch bracket 200 with the pivot pin 34.

Figure 18:
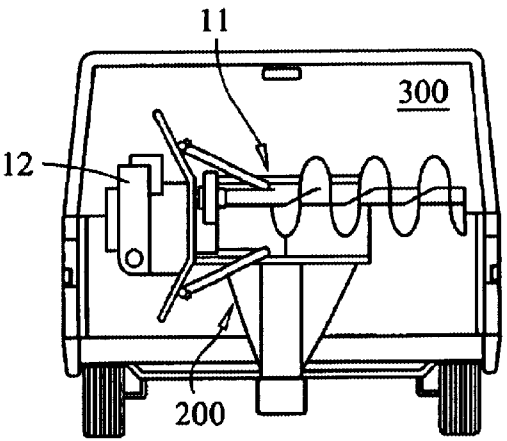
FIG. 18 is a rear view of a second embodiment of a auger mounting assembly attached to motor vehicle with a sliding bearing assembly in a horizontal orientation.
Figure 17:
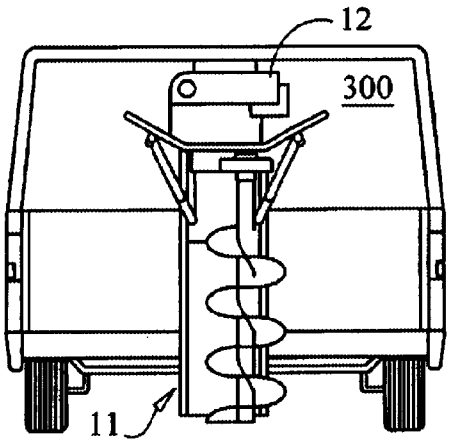
FIG. 17 is a rear view of a second embodiment of a auger mounting assembly attached to motor vehicle with a sliding bearing assembly in a vertical orientation.

A locking hole 222 is formed through the locking plate 218 to receive the spring loaded locking pin 140 of the catch and release mechanism. The spring loaded locking pin 140 prevents the slide bearing frame 90 from rotating relative to the hitch bracket 200. With reference to FIG. 17, the auger mounting assembly 11 is shown in a vertical orientation for creating a hole. With reference to FIG. 18, the auger mounting assembly 11 is shown in a horizontal orientation for storage or transportation of the auger 12. The mounting plate 24 and the hitch bracket 200 may both be referred to as mounting devices.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of mounting of an auger to a motor vehicle, comprising the steps of:

providing a mounting bracket for removably mounting the auger thereto;

attaching said mounting bracket to a bracket pad;

retaining slidably said bracket pad in a bearing frame by attaching a slide rail to each end of said bearing frame, said slide rails slidably retaining said bracket pad;

attaching a mounting device to the motor vehicle; and connecting pivotally said bearing frame to said mounting device, said bearing frame pivoting in a plane substantially parallel to a rear of the motor vehicle.

2. The method of mounting of an auger to a motor vehicle of claim 1, further comprising the step of:

locking said bearing frame in a horizontal orientation for transport of the auger.

3. The method of mounting of an auger to a motor vehicle of claim 1, further comprising the step of:

biasing said bracket pad in said bearing frame with at least one spring.

4. The method of mounting of an auger to a motor vehicle of claim 1, further comprising the step of:

providing a mounting plate for said mounting device, said mounting plate being attachable to a rear of a motor vehicle.

5. The method of mounting of an auger to a motor vehicle of claim 1, further comprising the step of:

providing a hitch bracket for said mounting device, said hitch bracket being attachable to a hitch of the motor vehicle.

6. The method of mounting of an auger to a motor vehicle of claim 1, further comprising the step of:

attaching an outer bearing to said bearing frame, attaching an inner bearing to said mounting device, inserting a pin through said inner and outer bearings to pivotally connect said mounting device to said bearing frame.

7. The method of mounting of an auger to a motor vehicle of claim 1, further comprising the step of:

providing said mounting bracket with at least one support member, at least one fastening device being used to attach an auger handle to said at least one support member.

8. A method of mounting of an auger to a motor vehicle, comprising the steps of:

providing a mounting bracket for removably mounting the auger thereto, said mounting bracket including at least one support member, at least one fastening device being used to attach an auger handle to said at least one support member;

attaching said mounting bracket to a bracket pad;

retaining slidably said bracket pad in a bearing frame by attaching a slide rail to each end of said bearing frame, said slide rails slidably retaining said bracket pad;

attaching a mounting device to a rear of the motor vehicle; and connecting pivotally said bearing frame to said mounting device.

9. The method of mounting of an auger to a motor vehicle of claim 8, further comprising the step of:

locking said bearing frame in a horizontal orientation for transport of the auger.

10. The method of mounting of an auger to a motor vehicle of claim 8, further comprising the step of:

biasing said bracket pad in said bearing frame with at least one spring.

11. The method of mounting of an auger to a motor vehicle of claim 8, further comprising the step of:

providing a mounting plate for said mounting device, said mounting plate being attachable to a rear of a motor vehicle.

12. The method of mounting of an auger to a motor vehicle of claim 8, further comprising the step of:

providing a hitch bracket for said mounting device, said hitch bracket being attachable to a hitch of the motor vehicle.

13. The method of mounting of an auger to a motor vehicle of claim 8, further comprising the step of:

attaching an outer bearing to said bearing frame, attaching an inner bearing to said mounting device, inserting a pin through said inner and outer bearings to pivotally connect said mounting device to said bearing frame.

14. A method of mounting of an auger to a motor vehicle, comprising the steps of:

providing a mounting bracket for removably mounting the auger thereto;

attaching said mounting bracket to a bracket pad;

retaining slidably said bracket pad in a bearing frame by attaching a slide rail to each end of said bearing frame, said slide rails slidably retaining said bracket pad;

biasing said bracket pad in said bearing frame with at least one spring:

attaching a mounting device to the motor vehicle; and connecting pivotally said bearing frame to said mounting device, said bearing frame pivoting in a plane substantially parallel to a rear of the motor vehicle.

15. The method of mounting of an auger to a motor vehicle of claim 14, further comprising the step of:

locking said bearing frame in a horizontal orientation for transport of the auger.

16. The method of mounting of an auger to a motor vehicle of claim 14, further comprising the step of:

providing a mounting plate for said mounting device, said mounting plate being attachable to a rear of a motor vehicle.

17. The method of mounting of an auger to a motor vehicle of claim 14, further comprising the step of:

providing a hitch bracket for said mounting device, said hitch bracket being attachable to a hitch of the motor vehicle.

18. The method of mounting of an auger to a motor vehicle of claim 14, further comprising the step of:

attaching an outer bearing to said bearing frame, attaching an inner bearing to said mounting device, inserting a pin through said inner and outer bearings to pivotally connect said mounting device to said bearing frame.

19. The method of mounting of an auger to a motor vehicle of claim 14, further comprising the step of:

providing said mounting bracket with at least one support member, at least one fastening device being used to attach an auger handle to said at least one support member.

* * * * *